US005482160A

United States Patent [19]

Perrin

[11] Patent Number: 5,482,160

[45] Date of Patent: Jan. 9, 1996

[54] GOLF BAG

[75] Inventor: Stephen J. Perrin, Camarillo, Calif.

[73] Assignee: Illah/California Inc., Oxnard, Calif.

[21] Appl. No.: 296,709

[22] Filed: Aug. 26, 1994

[51] Int. Cl.[6] ..... A63B 55/00

[52] U.S. Cl. ..... 206/315.8; 135/125

[58] Field of Search ..... 206/315.8, 315.3, 206/315.6, 315.4, 315.5; 135/120.3, 123, 124, 125; 190/24

[56] References Cited

U.S. PATENT DOCUMENTS

| | | | |
|---|---|---|---|
| 1,177,949 | 4/1916 | Homme | 135/123 |
| 1,429,524 | 9/1922 | Myers | 206/315.8 |
| 2,435,479 | 2/1948 | Thomman | 206/315.8 |
| 2,476,932 | 7/1949 | Tucker | 190/24 X |
| 3,435,866 | 4/1969 | Cantwell | 206/315.6 X |
| 3,448,748 | 6/1969 | Walrave | 135/120.3 X |
| 4,378,039 | 3/1983 | Suk | 206/315.8 |
| 4,448,305 | 5/1984 | Sup | 206/315.8 |
| 4,691,823 | 9/1987 | Pape | 206/315.6 |
| 4,881,638 | 11/1989 | Cho | 206/315.6 X |
| 5,299,590 | 4/1994 | Deibert et al. | 135/125 |

*Primary Examiner*—Allan N. Shoap
*Assistant Examiner*—Christopher J. McDonald
*Attorney, Agent, or Firm*—Lyon & Lyon

[57] ABSTRACT

A golf bag comprised of a frame and a fabric body carried by the frame in a taut disposition thereon. The frame includes an upper annular support member, a lower support member forming the bottom of the golf bag and a plurality of flexible and resilient stays extending between the upper and lower support members in a flexed disposition so as to continuously urge the upper and lower support members axially apart and maintain the fabric body in tension therebetween. The flexible and resilient stays also provide the golf bag with a flexible side support which is comfortable against the body of a person carrying the bag and allows the bag to undergo abuse without the fabric body of the bag losing its shape.

18 Claims, 4 Drawing Sheets

FIG. 1.
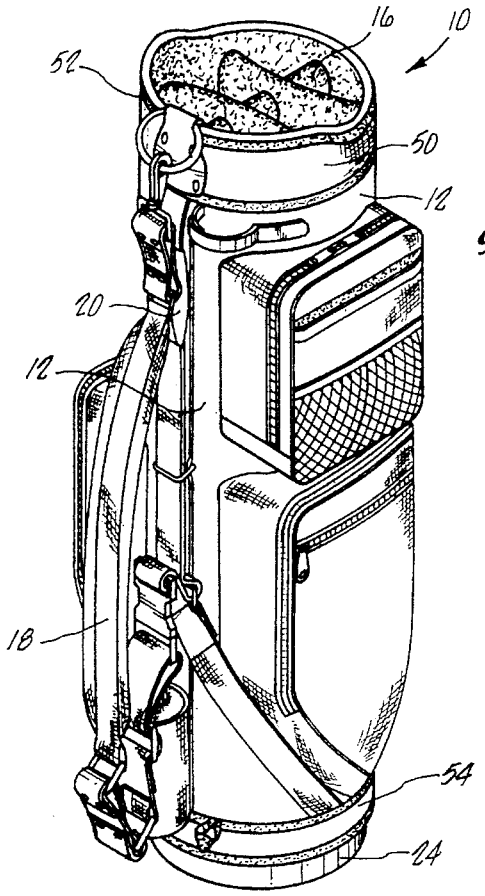
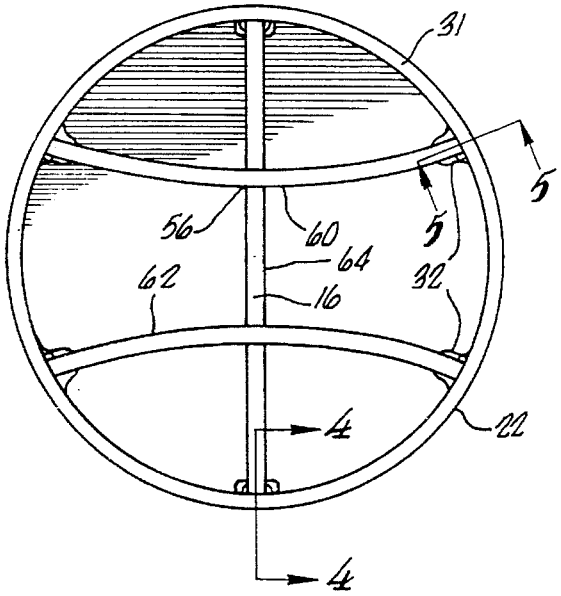
FIG. 3.
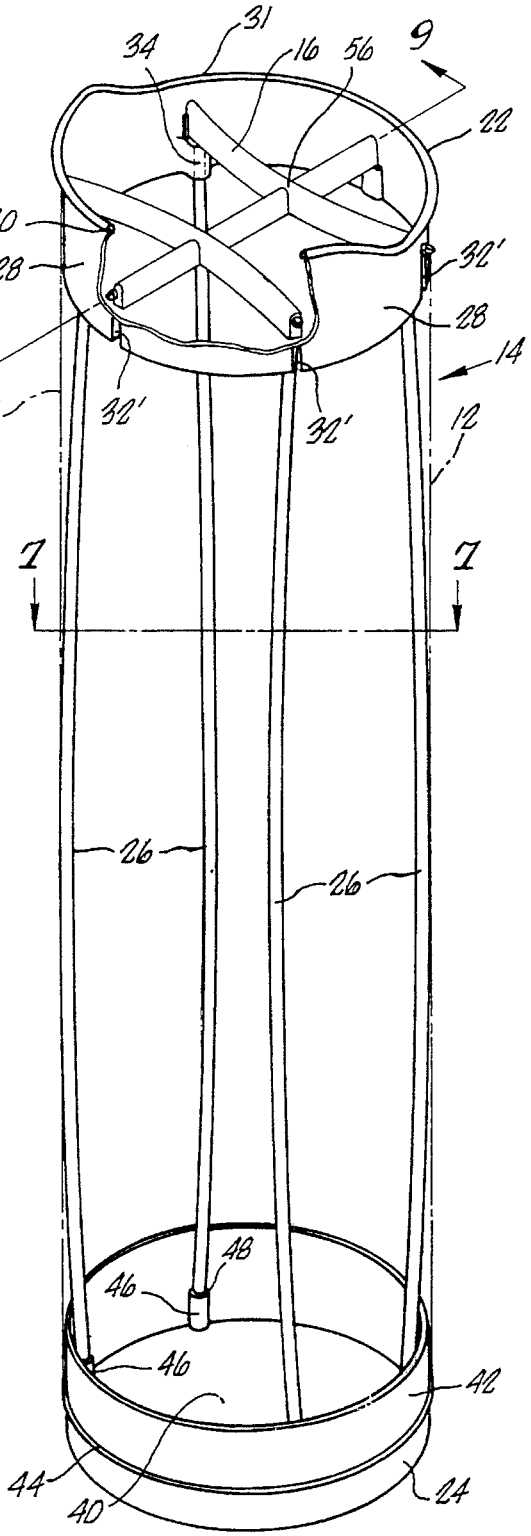
FIG. 2.

FIG. 4.
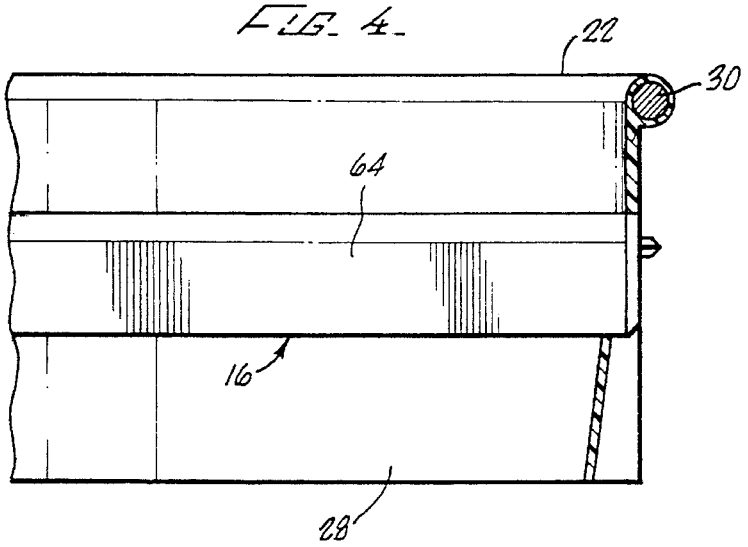
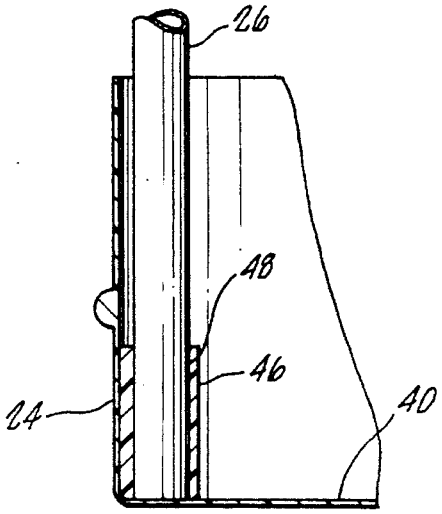
FIG. 6.
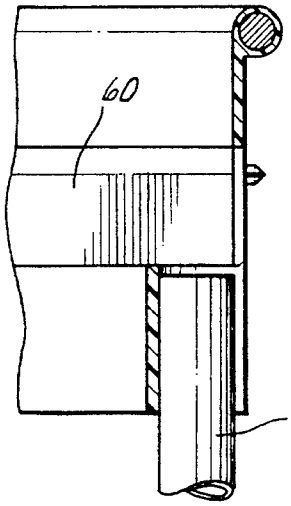
FIG. 5.
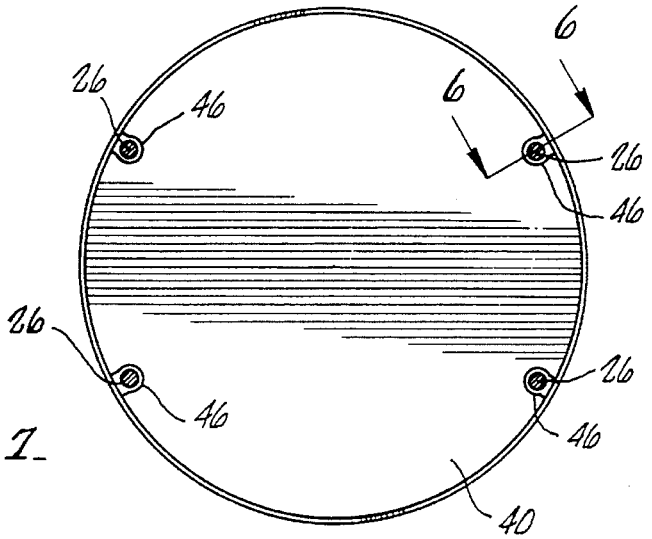
FIG. 7.

GOLF BAG

BACKGROUND OF THE INVENTION

The present invention relates to a reinforced golf bag of novel construction. Reinforced golf bags, unlike small ultralight carrying bags, typically employ a plurality of vertically disposed stays which extend along the interior of the fabric body of the bag between the upper and lower end supports thereof to provide structural support for the fabric and retain the fabric body in a taut, generally cylindrical configuration. These support stays are typically formed of cylindrical steel rods which are of a relatively small diameter to avoid adding undue weight to the bag. To secure the stays to the upper and lower end supports of the bag, small loops are formed at the extended ends of the stays through which the stays are riveted to the upper and lower end supports. Because these stays are relatively thin and extend virtually the entire length of the golf bag, they are very flexible and highly susceptible to being permanently bent. If one or more of the reinforcing stays becomes bent, the bag body will be somewhat distorted, distracting from its appearance. If the stay is bent inwardly, it will interfere with the golf clubs carried therein. Rigid fiberglass stays have also been used to reinforce the sides of the fabric body of the bag which, while being noticeably heavier than the metal stays, are not susceptible to being permanently bent. Fiberglass stays are typically held in sockets in the upper and lower ends of the bag and extend therebetween adjacent the fabric body.

While the above-described reinforcing stay configurations have been employed for years in the manufacture of golf bags, they have inherent shortcomings. Not only are metal stays very susceptible to being permanently bent, they also present manufacturing difficulties. To secure conventional metal stays to the upper and lower end supports of the bag, it is not only necessary to properly position the stays relative to the end supports and individually rivet each stay in place, but after the stays have been riveted in place to the lower end support, the fabric bag body must be pulled tight and maintained in a taut disposition between the end supports during the riveting of the stays to the upper end support to provide the golf bag with its desired appearance. Because of the limited support provided by thin metal stays, five such stays are typically employed to provide the desired reinforcement for the bag. Securement of the stays is thus a time consuming and relatively costly process. A similar problem exists when using the rigid fiberglass stays if the fabric body is to be held in the desired taut disposition. After the fabric body is secured to the lower end support of the bag and pulled upwardly about the fiberglass stays, the fabric must be held taut between the upper and lower end supports while it is sewn or riveted to the upper end support of the bag. If the need to individually rivet each stay in place could be obviated and/or if the fabric body could be secured in place to the bag frame in a taut disposition without concurrently having to hold it taut to obtain the desired bag appearance, the construction of such golf bags could be significantly simplified and the cost thereof reduced. The golf bag construction of the present invention achieves these results.

The present invention also provides a superior product. While the rigid fiberglass support stays used in reinforced golf bags may enhance the structural integrity of the golf bag and are not suspectable to bending, they increase the weight of the bag. Weight is always a very important consideration for any golfer who carries his own bag. Because of their rigidity, these fiberglass stays are quite uncomfortable when pressing against the side of a person carrying the bag filled with a set of golf clubs. In addition, the fabric of which the body of the bag is formed will stretch over time. Because these support stays are of a fixed length, the stretched material will no longer be held taut between the end supports of the bag and will wrinkle, detracting from the appearance of the golf bag. The problem of fabric stretching also exists when using metal stays as they also are of a fixed length. As the metal stays are very flexible, the stays themselves do not cause discomfort when pressed against the side of a person carrying the bag. However, it has been found that metal stays are typically so flexible that they will so readily flex when pressed against one's side that the shafts of the golf clubs within the bag will bear against the side of the carrier. As golf club shafts are relatively stiff, a similar discomfort results.

Because metal support stays are typically secured to the upper and lower end supports of the bag by rivets extending through the loops formed in the ends of the stays, the stays can collectively pivot slightly about their rivet attachments. This can occur as a result of continually leaning the golf bag against a wall or when one pulls laterally on one end of the bag relative to the other end as, for example, when forcibly withdrawing a club from the bag. The collective pivoting of the stays will distort and unbalance the bag. This problem can be exacerbated by the use of fabric dividers. Reinforced golf bags frequently employ fabric dividers which extend downwardly from rigid partitions carried by the upper end support of the golf bag to define separate areas within the bag for groups of clubs. These fabric dividers are typically secured periodically along their lateral edges to the support stays by straps or rivets to hold the dividers in place. The fabric dividers are secured periodically to the metal support stays as the stays are typically disposed in fabric sheaths which extend along the interior of the fabric body of the bag. This encasement of the stays helps prevent thin metal stays from taking a permanent bend. As a result, however, it is not uncommon for the grip end of a golf club to be inserted into the bag such that it become wedged between the stay and the fabric divider. When forcibly pulled from the bag, the wedged club will pull on the divider and stay and tend to pivot the stays and distort the bag and in some cases, bend the stay or tear the divider. The golf bag construction of the present invention not only simplifies the manufacture of reinforced golf bags having taut fabric bodies, but also enhances and better maintains the appearance and structural integrity of the bag while rendering the bag lighter and more comfortable to carry.

SUMMARY OF THE INVENTION

Briefly, the present invention comprises a new construction for a golf bag in which the upper and lower end supports of the bag which carry the fabric body of the bag are continuously urged apart by a plurality of light weight and highly durable elongated resilient support stays extending therebetween in a flexed disposition so as to maintain the fabric body in a taut disposition. The durability and resilience in the stays provide improved structural support for the golf bag with only four such stays, reducing the weight of the bag while allowing the bag to be crushed, twisted or similarly abused without loosing its shape. The flexibility characteristics of the stays provide the golf bag with a degree or flexibility in the side of the bag which is more comfortable for a player or a caddie when carrying the bag filled with clubs. The use of flexed resilient stays additionally facilitates the manufacture of a reinforced golf bag as the stays are readily mounted in opposed open channels formed in the bag end supports and, in a flexed state, will maintain the fabric body in tension between the end supports, thereby eliminating the time consuming tasks of having to rivet individual support stays in place and having to hold the bag fabric in a taut disposition during the riveting process. As a result, a superior golf bag is provided at a lower cost of manufacture.

It is the principal object of the present invention to provide an improved construction for a reinforced golf bag which both simplifies the manufacturing process and provides a more durable golf bag.

It is another object of the present invention to provide a golf bag which maintains the fabric body of the bag in a taut disposition to enhance the appearance of the bag.

It is yet another object of the present invention to provide a light weight reinforced golf bag which is more comfortable to carry than the reinforced golf bags heretofore available.

These and other objects and advantages of the present invention will become readily apparent from the following detailed description taken in conjunction with the accompanying drawings.

IN THE DRAWINGS

FIG. 1 is perspective view of the golf bag of the present invention.

FIG. 2 is a perspective view of the frame of the golf bag of the present invention.

FIG. 3 is a top plan view of the frame of the golf bag of the present invention.

FIG. 4 is a sectional view taken along line 4—4 of FIG. 3 showing the securement of the top dividers and flexible support stays to the upper end support of the golf bag.

FIG. 5 is a sectional view taken along the line 5—5 in FIG. 3 showing the rod reinforcement in the rim of the upper end support of the golf bag.

FIG. 6 is a sectional view taken along the line 6—6 in FIG. 7 showing the securement of the flexible support stays to the lower ends support of the golf bag.

FIG. 7 is a sectional view taken along the line 7—7 in FIG. 2.

DESCRIPTION OF THE PREFERRED EMBODIMENT

Figure 8:
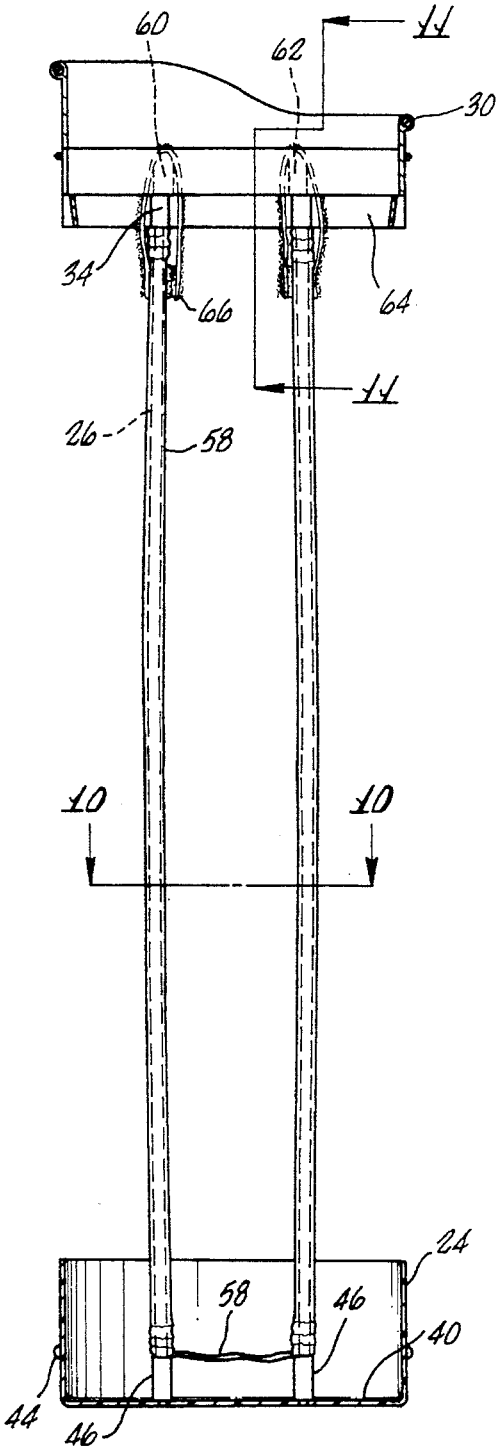
FIG. 8 is a partial sectional side view of the golf bag frame showing the fabric divider secured thereto.

Referring now in detail to the drawings, the golf bag 10 of the present invention comprises a fabric body 12, a frame 14, a plurality of club dividers 16, a shoulder strap 18 and a carrying handle 20. The frame 14 is comprised of an upper end support 22, a lower end support 24 and plurality of durable, flexible and resilient support stays 26 disposed therebetween. The body 12 of the golf bag 10, shown in phantom lines in FIG. 2, is disposed about support stays 26 and is secured to and extends between the upper and lower end supports 22 and 24 in a cylindrical configuration. The body 12 of the golf bag can be formed of any desired material such as nylon, leather or vinyl and can be provided with any desired array of accessory pockets and attachments as seen in FIG. 1.

The upper end support 22 in golf bag 10 is preferably molded of polypropylene or other durable plastic material and defines an annular side wall 28 having a steel reinforcing ring 30 molded into the upper end 31 thereof which extends about the open upper end of the golf bag and maintains said end in its desired configuration. A plurality of radial elongated slots 32 are preferably provided in side wall 28 of the upper end support 22 for the mounting of the club dividers 16 therein as will be later described. To accommodate the preferred configuration of club dividers 16, slots 32 are preferably arranged such that two of said slots (identified as 32' in FIG. 2) are disposed in a spaced relationship on each side of end support 22 and two slots 32"0 are aligned with the central axis of the end support (through which section line 9—9 is taken in FIG. 2). Integrally formed with side wall 28 are four inwardly disposed projections 34, each having a cylindrical stay receiving channel 36 formed therein which is closed at its upper end and open at its lower ends to receive the upper end portion of one of the support stays 26 therein. Projections 34 are disposed below and in axial alignment with the laterally disposed slots 32' in end support 22.

The lower end support 24 of golf bag frame 14 is also molded of a durable plastic material such as polypropylene and defines a circular bottom wall 40, an annular side wall 42 extending upwardly therefrom, an annular rib 44 extending about the exterior surface of side wall 42 and four inwardly disposed projections 46 extending upwardly from bottom wall 40 along a lower portion of side wall 42. As seen in FIG. 6, projections 46 each have a cylindrical stay receiving channel 48 formed therein which is closed at its lower end and open at its upper end to receive therein a lower end portion of one of the support stays 26. The stay receiving channels 48 in the lower end support 24 are axially aligned with channels 36 in the upper end support 22 such that the supporting stays 26 extend therebetween in substantial parallel alignment. The supporting stays 26 are described as being in substantial parallel alignment because in the completed golf bag, they extend between the end supports 22 and 24 in a slightly bowed or flexed disposition as seen in FIG. 2 and as will now be explained.

The upper and lower ends of the cylindrical fabric body 12 are sewn onto or otherwise secured to and about the side walls 28 and 42 of the upper and lower end supports 22 and 24. The upper end portions of support stays 26 are disposed within cylindrical channels 36 in projections 34 on the upper end support 22 of the frame and the lower end portions of support stays 26 are disposed within the cylindrical channels 48 in projections 46 on the lower end support 24 of frame 14. Support stays 26 are both flexible and resilient such that they can withstand severe bending and still return to a straight line disposition. The stays are of a length relative to the height of fabric body 12 so as to abut the closed ends of channels 36 and 48 and extend therebetween in a slightly flexed disposition when the fabric body is taut between the end supports 22 and 24 as illustrated in FIG. 2. The stays also exhibit an elastic deformation such that in this configuration the upper and lower end supports 22 and 24 are continuously urged away from each other by the flexed stays so as to maintain the fabric bag body 12 in tension therebetween.

The fabric body of the golf bag will stretch slightly over time. The extent to which the fabric body 12 will stretch will depend on the fabric used. The fabric of which the body 12 of golf bag 10 is formed should be relatively inexpansible so that the bag body 12 will only undergo moderate stretching during use. The flex characteristics of the stays 26 and the length of the stays relative to the axial distance between the closed ends of channels 36 and 48, which determines the amount of deformation in the stays, should be such that the stays in a flexed state between end supports 22 and 24 can absorb such moderate stretching of the bag body 12 and continue to hold the fabric body taut. However, the stays should not be so flexible that when the bag is being carried, the shafts of the golf clubs in bag will bear against the side of the carrier as occurs with conventional metal stays. Nor should the stays be so rigid as to be unyielding against the side of the carrier.

To provide the flexibility characteristics necessary to obtain these results, stays 26 are about ¼ to 3/16 inches longer than the axial distance between the closed ends of channels 36 and 48 and, when suspended over a 28 inch span and subjected to an 880 gram central load, will elastically deflect a maximum distance of between about 0.20 to 0.50 inches, and preferably about 0.25 inches. By way of a comparison, a typical metal stay will deflect about 1.25 inches, a difference of over 400%. An example of stays having these flexibility characteristics while also being quite durable and having the resilient memory noted earlier herein are hollow protruded shafts of an E glass fiberglass/low modulus carbon fiber composite material, 32⅝ inches in length and having a 0.330 inch outer diameter and 0.170. inch inner diameter. Each of said shafts weighs 2.3 ounces and is thus lighter than the thin metal stays currently being used and considerably more durable. Stays 26 exhibiting these same flexibility characteristics could also be formed of other materials and configurations.

To finish the golf bag 10, a conventional fabric upper collar 50 and plastic welting 52 are disposed about the upper end portion of fabric body 12 and end support 22 and are sewn in place onto the sidewall 28 thereof, covering the upper end of the fabric body 12. A fabric collar 54 is also disposed about the bottom portion of fabric body 12 and is sewn or otherwise secured to the side wall 42 of the lower end support 24. The typical straps and mounting rings for securing the bag carrying handle 20 and shoulder strap 18 are sewn in place as in the construction of a conventional golf bag.

The club dividers 16 are defined by a rigid element 56 carried by the upper end support 22 of the bag and a strip 58 of fabric material, such as nylon, which extends from element 56 in an elongated generally "U" shaped configuration within bag body 12 to compartmentalize the interior of the bag. Element 56 is preferably of single piece construction molded of a polypropylene or other suitable material, and as seen in FIG. 3, defines a pair of spaced-apart transverse members 60 and 62 and a central member 64 normal thereto. For the most effective utilization of space, members 60 and 62 are slightly curved in opposite directions. Element 56 is preferably secured to the upper end support 22 by means of snap fitments of the extended ends of divider members 60–64 into the elongated slots 32 formed in the side wall of end support 22 as is also shown in FIG. 2. Alternatively, a conventional three-piece divider could be employed which would be secured to the upper end support 22 by rivets and straps as in conventional bag construction.

Figure 10:
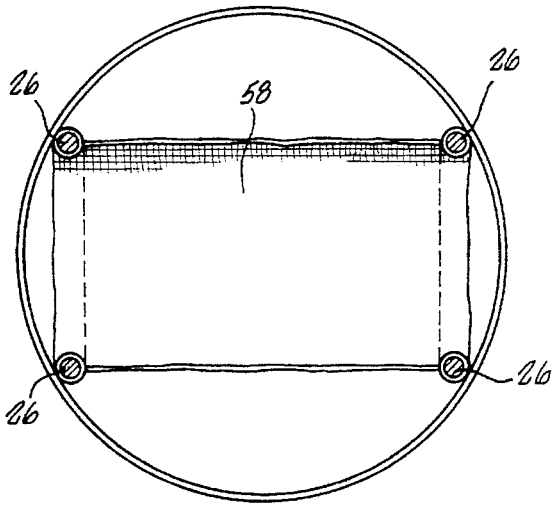
FIG. 10 is a sectional view taken along the line 10—10 in FIG. 8.
Figure 9:
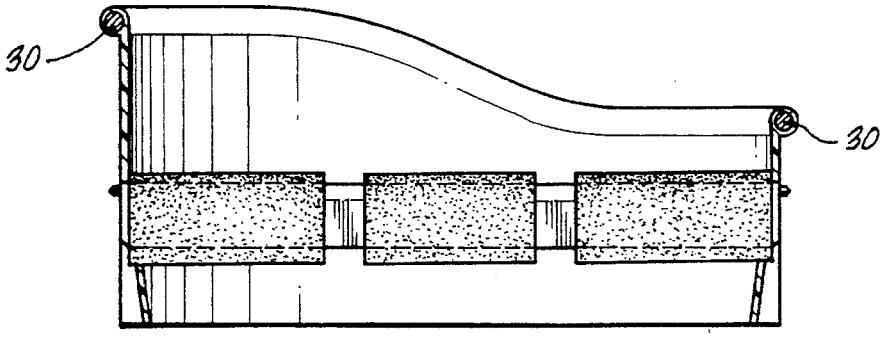
FIG. 9 is a sectional view taken along the line 9—9 in FIG. 2 showing the Velcro fur attachment to the cross-bar.
Figure 11:
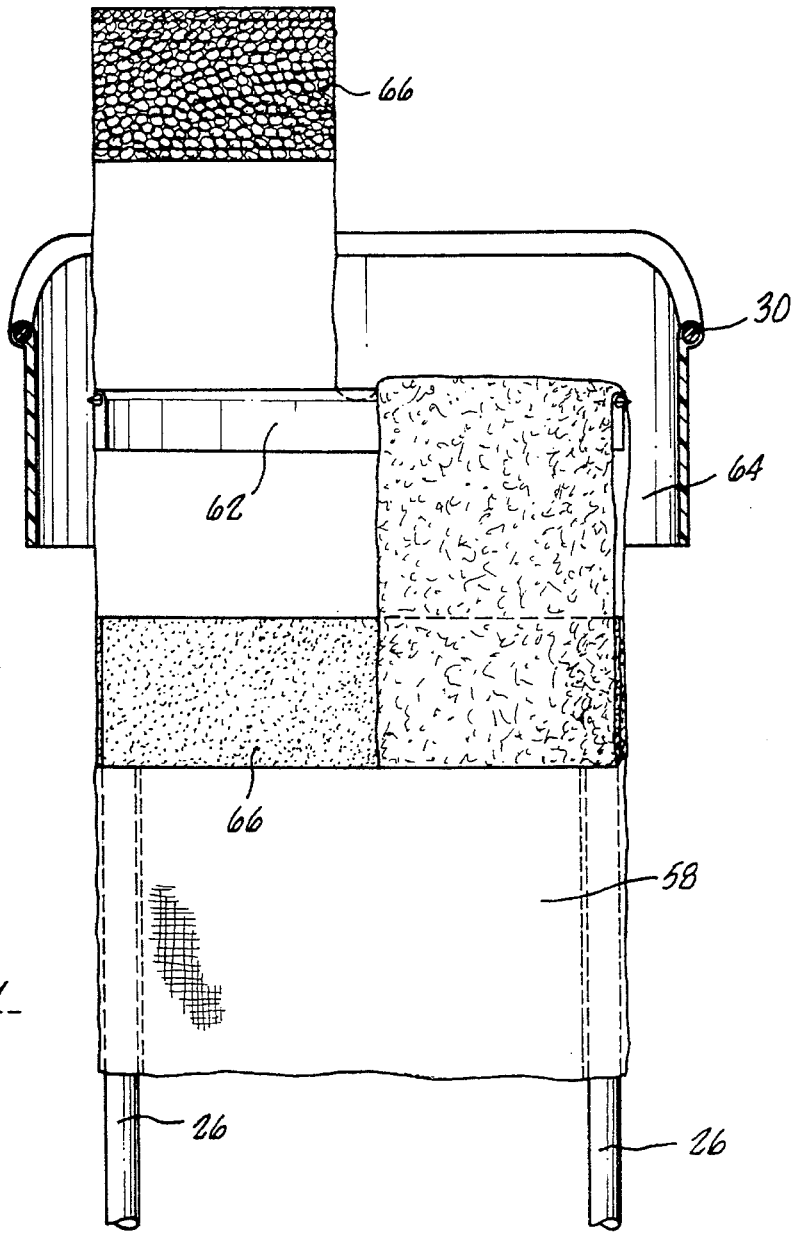
FIG. 11 is a sectional view taken along the line 11—11 in FIG. 8 but wherein a portion of one of the bifurcated ends of the fabric divider is extended vertically to illustrate the Velcro attachment of the fabric divider to one of the rigid transverse divider members.

As seen in FIGS. 7, 8 and 10, the fabric strip 58 is secured at one of its ends about transverse member 60, extends downwardly into the body of the bag between and parallel to the adjacent pair of support stays 26, extends parallel to the bottom wall 40 of the bag and upwardly to transverse member 62 between and parallel to a second pair of support stays 26. To secure the fabric divider defined by strip 58 in place, the extended end-portions 58' thereof are bifurcated (See FIG. 11) and preferably provided with hook and pile Velcro fastening means 66 such that end portions 58' can extend about the rigid transverse divider members 60 and 62 on either side of the central divider member 64 and be secured back against themselves as seen in FIGS. 8 and 11. The lateral edge portions of fabric strip 58 define elongated loops 70 sewn therein which define openings 70' proximate the extended ends thereof and openings 70" proximate the mid-portions thereof through which the support stays 26 disposed below radial slots 32' extend to hold the fabric strip 58 in place and maintain the elongated "U"-shaped configuration of the fabric divider. Securement of the fabric divider 58 to the support stays 26 substantially throughout the length of the stays also prevents one from wedging a golf club between a support stay and the fabric divider.

To provide additional protection for the golf clubs held within bag 10, layers of a synthetic fur material 72 or other suitable cushioning material is sewn onto the inner surface of sidewall 28 of end support 22 bag and about divider element 56. To provide the fur encasement of divider element 56, small sections 73 of synthetic fur material are sewn about divider member 64 and additional sections 74 of fur material are sewn onto the bifurcated end portions 58' of the fabric strip 58 which wrap about arcuate members 60 and 62 and are secured in place by fastening means 66.

As a result of the aforesaid configuration, the fabric body portion of the bag is continuously held in a taut disposition by virtue of the tension exerted thereon by the flexed support stays 26. The flexibility and resilience in the supporting stays 26 allow the body of the body to stretch and withstand substantial abuse without losing its shape and allow the side of the bag to flex slightly against the side of a person carrying the bag for increased comfort.

To construct golf bag 10 of the present invention, the fabric forming body 12 is first cut to its desired size and the accessory pockets are sewn in place. The fabric is then sewn along its extended longitudinal edge 12' into a cylindrical configuration. The lower end portion of the formed cylindrical fabric body 12 is then placed about the exterior surface of the side wall 42 of the lower end support 24 such that the lower end of the fabric body is substantially adjacent the outer rib 44 on side wall 42 and is sewn to the side wall of support 24. The upper end portion of the cylindrical fabric body is then disposed about the side wall 28 of the upper end support 22 and sewn thereto. The supporting stays 26 are then inserted into the receiving channels 48 in the lower end support 24. To assist in the insertion of stays 26 into channels 48, small openings 76 can be formed in the closed ends of channels 48 which, when held up to a light, will indicate the positioning of channels 48 which are otherwise obscured by the bottom of the fabric body 12. The fabric divider strip 58 is then secured about support stays 26 by sliding the elongated loops 70 formed in the lateral edge portions of strip 58 over the stays and pushing the divider strip down within the bag. The support stays are then bowed and the upper ends thereof are inserted into channels 36 in the upper end support 22. The fabric divider 64 is then pulled upwardly along support stays 26 and divider element 56 is snapped into place. The strips of cushioning fur are then secured about central member 64 of divider element 56 and the bifurcated ends of the fabric divider strip 58 are pulled over the rigid divider members 60 and 62 and secured thereto by their Velcro attachments.

While the divider element 56 is shown and described as being of molded single piece construction and secured to the upper end support 22 of the bag by a snap-lock fitment, other configurations and means of securing the divider in place could be employed. Golf bags could also be constructed in accordance with the present invention without dividers. Various other changes and modifications may also be made in carrying out the present invention without departing from the spirit and scope thereof. Insofar as these changes and modifications are within the purview of the appended claims, they are to be considered as part of the present invention.

I claim:

1. A golf bag comprising a frame and a fabric body carried by said frame in a taut disposition thereon, said frame comprising an upper support member, a lower support member, a first plurality of stay receiving channels defined by said upper support member, a second plurality of stay receiving channels defined by said lower support member in opposed axial alignment with said first plurality of channels so as to define a plurality of aligned pairs of opposed channels, a plurality of flexible resilient support stays, each of said stays extending into and between one of said pairs of opposed channels in a flexed disposition so as to continuously urge said upper and lower support members in axially opposed directions and thereby maintain said fabric body in tension therebetween, a rigid divider carried by and spanning said upper support member and an elongated fabric divider defining end portions and lateral edge portions, said end portions being carried by said rigid divider and said edge portions defining open-ended elongated loops, each of said loops extending about and along one of said stays.

2. The golf bag of claim 1 wherein the receiving channels in each of said pairs of channels are spaced axially apart a distance sufficient to maintain the support stay extending therebetween in a flexed disposition.

3. The golf bag of claim 1 wherein each of said aligned pairs of opposed channels defines an upper stay support surface and a lower stay support surface and each of said stays defines an axial length in an unflexed disposition and abuts and extends between an upper support surface and a lower support surface in a flexed disposition, said axial length being about ¼ to 3/16 inches greater than the axial distance between the upper and lower support surfaces defined by each of said pair of opposed channels.

4. A golf bag comprising a frame and a fabric body carried by said frame in a taut disposition thereon said frame comprising an upper support member, a lower support member, a first plurality of stay receiving channels defined by said upper support member, a second plurality of stay receiving channels defined by said lower support member in opposed axial alignment with said first plurality of channels so as to define a plurality Of aligned pairs of opposed channels, a plurality of flexible resilient support stays, each of said stays defining an elastic flexibility such that when suspended over a 28 inch span and subjected to a central load of 880 grams, said stays will elastically deflect a maximum distance of about 0.20 to 0.50 inches and wherein each of said stays extends into and between one of said pairs of opposed channels in a flexed disposition so as to continuously urge said upper and support members in axially opposed directions and thereby maintain said fabric body in tension therebetween.

5. The golf bag of claim 4 wherein said stays define hollow shafts of a fiberglass/carbon fiber composite material.

6. A golf bag comprising a frame and a fabric body carried by said frame in a taut disposition thereon, said frame comprising an upper support member, a lower support member, a first plurality of stay receiving channels defined by said upper support member, a second plurality of stay receiving channels defined by said lower support member in opposed axial alignment with said first plurality of channels so as to define a plurality of aligned pairs of opposed channels, a plurality of flexible resilient support stays, each of said stays defining an elastic flexibility such that when suspended over a 28 inch span and subjected to a central load of 880 grams, said stays will elastically deflect a maximum distance of about 0.25 inches and wherein each of said stays extends into and between one of said pairs of opposed channels in a flexed disposition so as to continuously urge said upper and support members in axially opposed directions and thereby maintain said fabric body in tension therebetween.

7. A golf bag comprising a frame and a fabric body carried by said frame in a taut disposition thereon, said frame comprising an upper support member, a lower support member, a first plurality of stay receiving channels defined by said upper support member, a second plurality of stay receiving channels defined by said lower support member in opposed axial alignment with said first plurality of channels so as to define a plurality of aligned pairs of opposed channels, a plurality of flexible resilient support stays, each of said stays extending into and between one of said pairs of opposed channels in a flexed disposition so as to continuously urge said upper and lower support members in axially opposed directions and thereby maintain said fabric body in tension therebetween, a rigid divider carried by said upper support member, said divider comprising a pair of spaced transverse members extending across and abutting said upper support member at locations thereon axially aligned with one of said pairs of receiving channels, and an elongated fabric divider defining end portions and lateral edge portions, each of said edge portions defining a pair of open-ended elongated loop portions therein, one of said stays extending through each of said loop portions and one of said end portions of said fabric divider being secured to one of said transverse members whereby said fabric divider is maintained in an elongated "U"-shaped configuration within said fabric body so as to divide the interior of said body into a plurality of gold club receiving areas.

8. The golf bag of claim 7 including hook and pile fastening means carried by the end portions of said fabric divider for securing said end portion about said spaced transverse members.

9. The golf bag of claim 7 including a spanning member carried by said rigid divider and extending across said upper support member transversely of said spaced transverse members and wherein each of said end portions of said fabric divider is bifurcated and extends about portions of one of said transverse members separated by said spanning member and including hook and file fastening means carried by said bifurcated end portions for securing said bifurcated end portions about said portions of said transverse members.

10. A golf bag comprising an upper body support member, a plurality of upper stay support surfaces carried by said support member, a lower body support member, a plurality of lower stay support surfaces carried by said lower support member in axial alignment with said upper support surfaces so as to define a plurality of pairs of aligned support surfaces, a substantially cylindrical fabric body carried by and extending between said upper and lower body support members in a taut disposition therebetween, a plurality of flexible resilient support stays disposed interiorially of said fabric body, each of said support stays abutting and extending between one of said aligned pairs of support surfaces and defining an axial length in an unflexed state greater than the axial distance between the support surfaces in each of said aligned pairs thereof so as to cause said stays to extend therebetween in a flexed disposition and maintain said fabric body in a taut disposition between said support members, a rigid divider carried by and spanning said upper support member and an elongated fabric divider defining end portions and lateral edge portions, said end portions being carried by said rigid divider and said edge portions defining open-ended elongated loops, each of said loops extending about and along one of said stays.

11. A golf bag comprising an upper body support member, a plurality of upper stay support surfaces carried by said support member, a lower body support member, a plurality of lower stay support surfaces carried by said lower support member in axial alignment with said upper support surfaces so as to define a plurality of pairs of aligned support surfaces, a substantially cylindrical fabric body carried by and extending between said upper and lower body support members in a taut disposition therebetween and a plurality of flexible resilient support stays disposed interiorially of said fabric body, each of said support stays abutting and extending between of said aligned pairs of support surfaces and defining an axial length in an unflexed state about ¼ to 3/16 inches greater than the axial distance between the support surfaces abutting said stay so as to cause said stays to extend therebetween in a flexed disposition and maintain said fabric body in a taut disposition between said support members.

12. A golf bag comprising an upper body support member, a plurality of upper stay support surfaces carried by said support member, a lower body support member, a plurality of lower stay support surfaces carried by said lower support member in axial alignment with said upper support surfaces so as to define a plurality of pairs of aligned support surfaces, a substantially cylindrical fabric body carried by and extending between said upper and lower body support members in a taut disposition therebetween and a plurality of flexible resilient support stays disposed interiorially of said fabric body, each of said support stays abutting and extending between one of said aligned pairs of support surfaces and defining an axial length in an unflexed state greater than the axial distance between the support surfaces in each of said aligned pairs thereof so as to cause said stays to extend therebetween in a flexed disposition and maintain said fabric body in a taut disposition between said support members, said stays additionally defining an elastic flexibility such that when suspended over a 28 inch span and subjected to a central load of 880 grams, said stays will elastically deflect a maximum distance of about 0.20 to 0.50 inches.

13. A golf bag comprising an upper body support member, a plurality of upper stay support surfaces carried by said support member, a lower body support member, a plurality of lower stay support surfaces carried by said lower support member in axial alignment with said upper support surfaces so as to define a plurality of pairs of aligned support surfaces, a substantially cylindrical fabric body carried by and extending between said upper and lower body support members in a taut disposition therebetween and a plurality of flexible resilient support stays disposed interiorially of said fabric body, each of said support stays abutting and extending between one of said aligned pairs of support surfaces and defining an axial length in an unflexed state greater than the axial distance between the support surfaces in each of said aligned pairs thereof so as to cause said stays to extend therebetween in a flexed disposition and maintain said fabric body in a taut disposition between said support members, said stays additionally defining an elastic flexibility such that when suspended over a 28 inch span and subjected to a central load of 880 grams, said stays will elastically deflect a maximum distance of about 0.25 inches.

14. A golf bag comprising an annular upper body support member, a plurality of upper stay support surfaces carried by said upper support member, a plurality of rigid dividers carried by an extending across said upper support member, a lower body support member, between, a plurality of flexible resilient support stays disposed interiorially of said fabric body, each of said support stays abutting and extending between one of said aligned pairs of support surfaces and defining an axial length in an unflexed state greater than the axial distance between the support surfaces in each of said aligned pairs thereof so as to cause said stays to extend therebetween in a flexed disposition and maintain said fabric body in a taut disposition between said support members and an elongated substantially "U"-shaped fabric divider defining end portions and lateral edge portions, said end portions being secured to said rigid members carried by said upper support member and each of said lateral edge portions extending about and along two of said support stays.

15. A golf bag comprising an upper body support member, a plurality of upper stay support members carried by said upper body support member, a lower body support member, a plurality of lower stay support members carried by said lower body support member in axial alignment with said upper stay support members so as to define a plurality of pairs of aligned stay support members, a substantially cylindrical fabric body carried by and extending between said upper and lower body support members in a taut disposition therebetween and a plurality of flexible resilient support stays disposed interiorially of said fabric body, said stays defining an elastic flexibility such that when suspended over a 28 inch span and subjected to a central load of 880 grams, said stays will elastically deflex a maximum distance of about 0.20 to 0.50 inches, each of said support stays abutting and extending between one of said aligned pairs of stay support members and defining an axial length in an unflexed state of about ¼ to 3/16 inches greater than the axial distance between said stay support members in each of said aligned pairs thereof so as to cause said stays to extend therebetween in a flexed disposition and maintain said fabric body in a taught disposition between said body support members.

16. The golf bag of claim 15, wherein said upper body support member is of an annular configuration and including a plurality of rigid members carried by and extending across said upper body support member, and an elongated substantially "U"-shaped fabric divider defining end portions and lateral edge portions, said end portions being secured to said rigid members carried by said upper body support member and each of said lateral edge portions extending about and along said support stays.

17. A golf bag comprising a frame and a fabric body carried by said frame in a taut disposition thereon, said frame comprising an upper support member, a lower support member, a first plurality of stay receiving channels defined by said upper support member, a second plurality of stay receiving channels defined by said lower support member in opposed axial alignment with said first plurality of channels so as to define a plurality of aligned pairs of opposed channels, a plurality of flexible resilient support stays, each of said stays extending into and between one of said pairs of opposed channels in a flexed disposition so as to continuously urge said upper and lower members in axially opposed directions and thereby maintain said fabric body in tension therebetween and wherein said stays define an elastic flexibility such that when suspended over a 28 inch span and subjected to a central load of 880 grams, said stays will elastically deflect a maximum distance of about 0.20 to 0.50 inches.

18. A golf bag comprising a frame and a fabric body carried by said frame in a taut disposition thereon, said frame comprising an upper support member, a lower support member, a first plurality of stay receiving channels defined by said upper support member, a second plurality of stay receiving channels defined by said lower support member in opposed axial alignment with said first plurality of channels so as to define a plurality of aligned pairs of opposed channels, a plurality of flexible resilient support stays, each of said stays extending into and between one of said pairs of opposed channels in a flexed disposition so as to continuously urge said upper and lower members in axially opposed directions and thereby maintain said fabric body in tension therebetween and wherein said stays define an elastic flexibility such that when suspended over a 28 inch span and subjected to a central load of 880 grams, said stays will elastically deflect a maximum distance of about 0.25 inches.

* * * * *